United States Patent [19]

Fujiwara et al.

[11] Patent Number: 4,802,827

[45] Date of Patent: Feb. 7, 1989

[54] COMPRESSOR

[75] Inventors: Takayoshi Fujiwara, Kawasaki; Toshikatsu Iida; Tetuo Fukuda, both of Yokohama, all of Japan

[73] Assignee: Kabushiki Kaisha Toshiba, Kawasaki, Japan

[21] Appl. No.: 137,680

[22] Filed: Dec. 24, 1987

[30] Foreign Application Priority Data

| | | | |
|---|---|---|---|
| Dec. 24, 1986 | [JP] | Japan | 61-309408 |
| Dec. 25, 1986 | [JP] | Japan | 61-307965 |
| Dec. 26, 1986 | [JP] | Japan | 61-315366 |

[51] Int. Cl.[4] ..... F04B 39/10; F04C 15/02

[52] U.S. Cl. ..... 417/356; 418/48

[58] Field of Search ..... 417/356, 365; 418/48; 175/107

[56] References Cited

U.S. PATENT DOCUMENTS

| | | | |
|---|---|---|---|
| Re. 29,180 | 4/1977 | Clark | 418/48 |
| 1,892,217 | 12/1932 | Moineau . | |
| 3,479,960 | 11/1969 | Cardoso . | |
| 4,011,917 | 3/1977 | Tiraspolsky et al. | 418/48 X |

FOREIGN PATENT DOCUMENTS

| | | | |
|---|---|---|---|
| 1188669 | 4/1970 | United Kingdom | 418/48 |
| 2037372 | 7/1980 | United Kingdom | 418/48 |

*Primary Examiner*—Leonard E. Smith
*Assistant Examiner*—Eugene L. Szczecina, Jr.
*Attorney, Agent, or Firm*—Cushman, Darby & Cushman

[57] ABSTRACT

A compressor includes a closed casing having a suction chamber and a discharge chamber. A rotating member is arranged in the casing and has a spiral bore extending along the axis of rotation of the rotating member. The bore has first and second end openings communicating with the suction and discharge chambers, respectively. A spiral internal member is inserted into the bore to rotate relative to the rotating member as the rotating member is rotated by an electric motor section in the casing. In conjunction with an inner surface of the bore, the internal member defines a plurality of closed spaces moving from the first end opening to the second end opening. A fluid in the suction chamber is transported from the first end opening to the second end opening while confined within the spaces, and is then discharged into the discharge chamber. The discharge of the fluid is controlled by a valve mechanism.

11 Claims, 5 Drawing Sheets

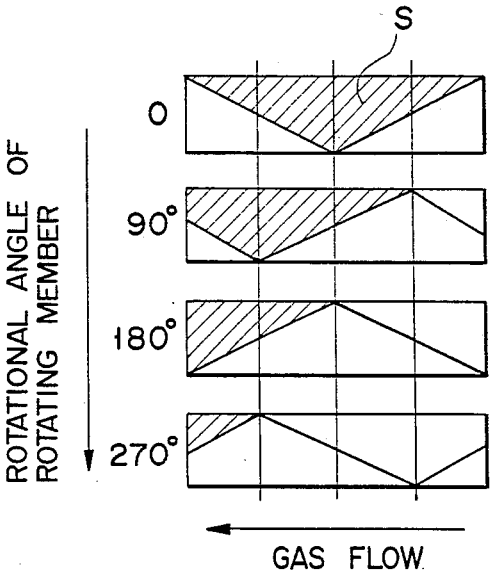
F I G. 8
F I G. 9A
F I G. 9B
F I G. 9C
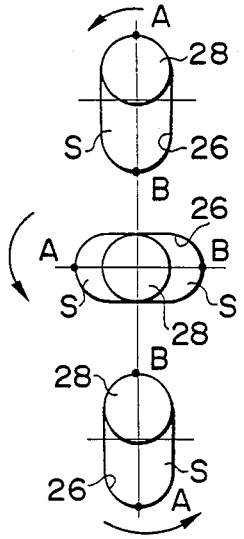

COMPRESSOR

BACKGROUND OF THE INVENTION

The present invention relates to a compressor used in a refrigerating cycle and the like.

Compressors of reciprocating and rotary types are generally known as ones adapted for use in a refrigerating cycle, for example. A reciprocating compressor comprises a cylinder and a piston. The piston is reciprocated by means of an eccentric shaft, which is located on the rotational shaft of an electric motor section, and a connecting rod.

In such a reciprocating compressor, a rotary motion is converted into a reciprocating motion, which requires a number of moving members and members for supporting or guiding the same. Accordingly, the compressor of this type includes many components, and has a complicated, large-sized structure, thus entailing increase in manufacturing costs. In this conventional compressor, moreover, the intake and discharge of a fluid vary intermittently, and the torque required for the drive of a piston also varies considerably. Thus, the compressor is liable to produce vibration and hence, noises.

A rotary compressor shares these problems with the reciprocating compressor.

SUMMARY OF THE INVENTION

The present invention has been contrived in consideration of these circumstances, and has an object to provide a compressor having a simple construction, permitting reduction in size, and being capable of continuous compression of fluids.

In order to achieve the above object, according to the present invention, there is provided a compressor which comprises a closed casing having a suction chamber and a discharge chamber; a rotating member rotatably disposed in the casing and having a spiral bore formed along the axis of rotation thereof, the bore having first and second end openings communicating with the suction chamber and the discharge chamber, respectively; an electric motor section disposed in the casing, for rotating the rotating member; a spiral internal member inserted in the bore of the rotating member so as to rotate relatively to the rotating member as the rotating member rotates, the internal member, in conjunction with the inner surface of the bore, defining a plurality of closed spaces moving from the first end opening to the second end opening, whereby a fluid in the suction chamber is transported from the first end opening to the second end opening with being confined within the spaces, and is then discharged into the discharge chamber; and valve means for controlling the discharge of the fluid from the second end opening into the discharge chamber.

BRIEF DESCRIPTION OF THE DRAWINGS

FIGS. 1 to 9C show a compressor according to an embodiment of the present invention, in which FIG. 1 is a longitudinal sectional view of the compressor, FIG. 2 is an enlarged cross-sectional view of a rotating member, FIG. 3 is an enlarged longitudinal-sectional view showing part of the rotating member, FIGS. 4 and 5 are a cross-sectional view and an enlarged side view, respectively, of an internal member, FIG. 6 is a front view schematically showing a rotation preventing mechanism, FIG. 7 is a sectional view of a valve mechanism, FIG. 8 is a schematic view illustrating processes of movement of a closed space, and FIGS. 9A, 9B and 9C are schematic views illustrating relative rotations of the rotating member and the internal member;

FIGS. 11 to 13 show a second modification of the valve mechanism, in which

FIG. 11 is a sectional view of the valve mechanism,

FIG. 12 is a front view of the valve mechanism, and

FIG. 13 is a sectional view taken along line XIII—XIII in FIG. 11;

FIGS. 14 and 15 show a compressor according to a second embodiment of the invention, in which FIG. 14 is a longitudinal sectional view of the compressor, and FIG. 15 is a plan view of a punched plate.

DETAILED DESCRIPTION OF THE PREFERRED EMBODIMENTS

Embodiments of the present invention will now be described in detail with reference to the accompanying drawings.

Figure 1:
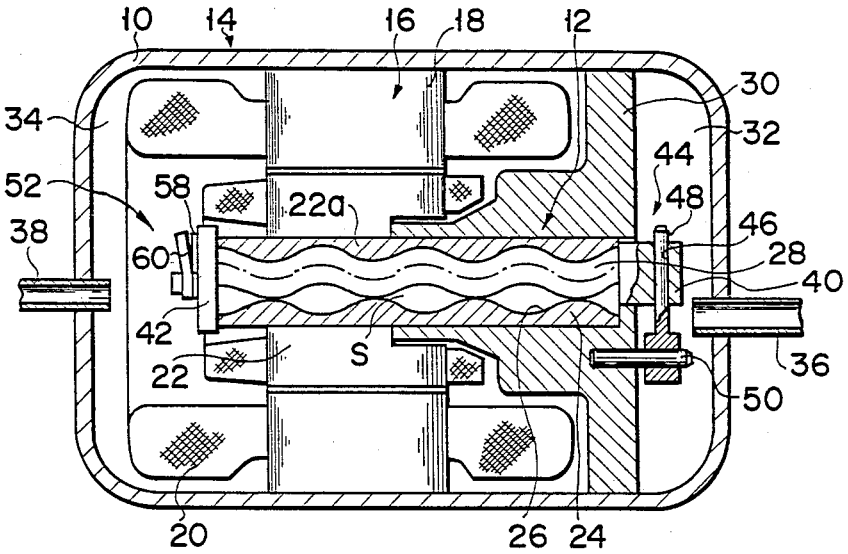

FIG. 1 shows a compressor according to an embodiment of the invention incorporated in a refrigerating cycle (not shown). This compressor has closed casing 10, which contains therein compressor section 12 and electric motor section 14 for driving section 12.

Motor section 14 has stator 16, which is composed of ring-shaped core 18 fixed to the inner peripheral surface of casing 10, and magnet coil 20 wound on the core. Cylindrical rotor 22 is disposed inside core 18 with a predetermined space between the two.

Compressor section 12 includes cylindrical rotating member 24, which is fixedly fitted in bore 22*a* of rotor 22, and internal member 28 inserted in bore 26 of member 24.

Both end portions of rotating member 24 project from their corresponding end faces of rotor 22. The right end portion of member 24 is rotatably supported by bearing 30, which is fixed to the inner surface of casing 10. Thus, rotor 22 rotates integrally with rotatable member 24, and member 24 doubles as the rotating shaft of rotor 22. The inside space of casing 10 is divided into suction chamber 32 and discharge chamber 34, by bearing 30. The right- and left-end openings of bore 26 of rotating member 24 communicate with chambers 32 and 34, respectively. Also, suction chamber 32 communicates with an evaporator of a refrigerating cycle (not shown) by means of pipe 36 attached to casing 10, while discharge chamber 34 communicates with a condenser by means of pipe 38.

Figure 2:
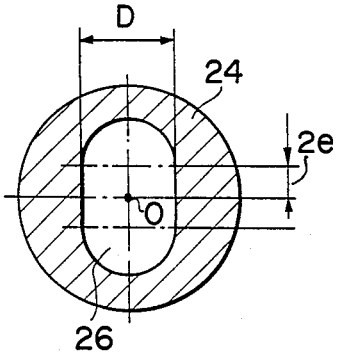
Figure 3:
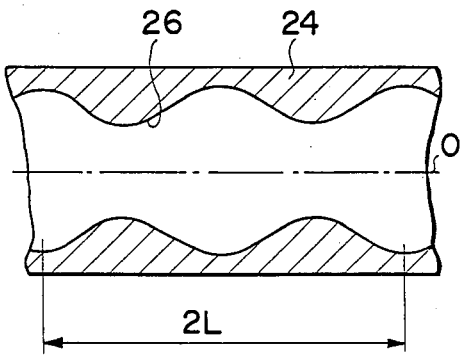

As is shown in FIGS. 1, 2 and 3, bore 26 of rotating member 24 is spiral in shape, extending coaxially with central axis 0 of member 24. The cross section of bore 26 is oblate in shape, that is, it has an outline consisting of a pair of parallel straight lines and a pair of semicircles continuous therewith. The diameter of each semicircle and the distance between the center of each semicircle and center 0 of bore 26 are designated as D and 2e, respectively. Bore 26 is formed so that the orientation of its cross section turns through 360° C. around center line 0 with every pitch 2L along line 0.

Figure 4:
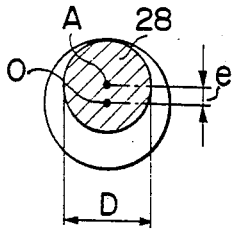
Figure 5:
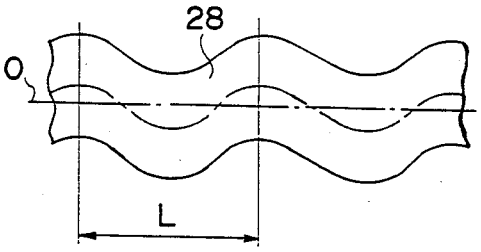

As is shown in FIGS. 4 and 5, internal member 28 is formed by spirally twisting a rod member having a circular cross section with diameter D around its central axis 0. The maximum eccentricity of center A of the cross section, with respect to axis 0, is designated as e, and one pitch of the spiral of member 28 is designated as L. As is shown in FIG. 1, internal member 28 and rotating member 24 have the same length. Columnar head portion 40, having a diameter greater than that of member 28, is fixed to the end face of member 28 on the side of suction chamber 32. Portion 40 is in partial intimate contact with the suction-side end face of rotating member 24 so that part of the suction-side end opening of bore 26 is open. Disk-shaped valve plate 42 of a valve mechanism (mentioned later) is fixed to that end face of internal member 28 on the side of discharge chamber 34. Plate 42 is in intimate contact with the discharge-side end face of rotating member 24 so that the discharge-side end opening of bore 2 of member 24 is closed thereby. Thus, head portion 40 and valve plate 42 prevent internal member 28 from moving axially, with respect to rotating member 24, only allowing relative rotations of members 24 and 28.

Figure 6:
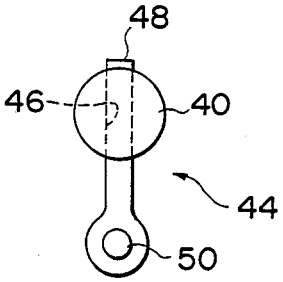

As is shown in FIGS. 1 and 6, internal member 28 is prevented from rotating on its own axis by rotation prevention mechanism 44, and is allowed only to move around central axis 0 of rotating member 24. Prevention mechanism 44 includes through hole 46, which is bored through head portion 40 so as to extend perpendicular to the central axis of the head portion, and guide pin 48 slidably passed through the through hole. Support pin 50 projects from bearing 30 into suction chamber 32. One end of guide pin 48 is supported by pin 50 so as to be rockable around an axis parallel to axis 0 of rotating member 24. Internal member 28 is prevented from rotating on its own axis by guide pin 48, and is allowed to move around axis 0 of member 24, accompanying the relative sliding action of head portion 40 and pin 48 as well as the rocking action of pin 48.

Figure 7:
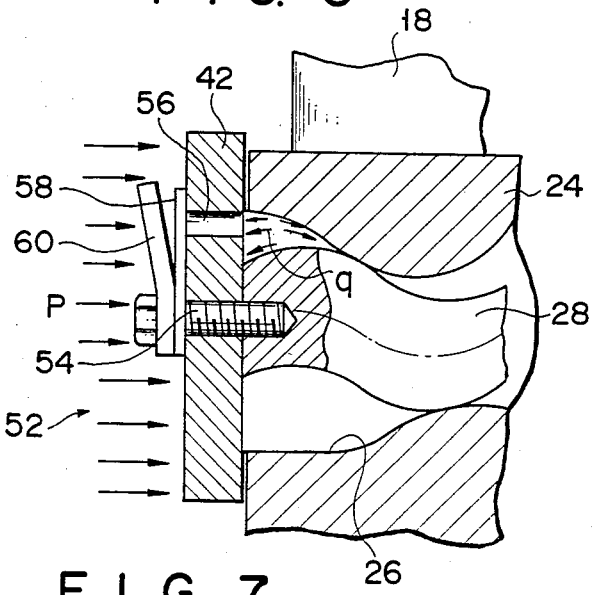

As is shown in FIG. 7, valve mechanism 52 includes valve plate 42, whose central portion is fixed to the discharge-side end face of internal member 28 by means of bolt 54. Plate 42 is formed with discharge hole 56 which extends in the axial direction of rotating member 24. Hole 56 is eccentric to the center of plate 42. When it faces one end portion of the discharge-side end opening of bore 26, with respect to the longitudinal direction thereof, i.e., the semicircular portion, as members 24 and 28 rotate and revolve, respectively, the discharge hole communictes with bore 26. Valve body 58 and valve guard 60 are mounted successively on that surface of valve plate 42 on the side of discharge chamber 34, by means of bolt 54. Valve body 58 is used to open and close discharge hole 56. More specifically, body 58 serves as a check valve which allows a fluid to flow from discharge hole 56 into discharge chamber 34, and prevents flowing in the opposite direction.

The operation of the compressor constructed in this manner will now be described.

First, when electric motor section 14 is actuated to rotate rotor 22, rotating member 24 is rotated integrally with the rotor. As member 24 rotates in this manner, internal member 28 is subjected to a force in a direction such that it rotates on its own axis, by the action of sliding in contact with the inner surface of bore 26 of the rotating member. Internal member 28 is prevented, however, from rotating on its own axis by rotation preventive mechanism 44, and moves around central axis 0 of rotating member 24. Thus, various parts of the outer peripheral surface of member 28 rotate relatively to the inner peripheral surface of bore 26 while touching and leaving the same. A plurality of closed spaces S are defined by the outer peripheral surface of internal member 28 and the inner peripheral surface of bore 26. Spaces S move from the suction-side end opening of bore 26 to the discharge-side end opening as rotating member 24 and internal member 28 rotate relatively to each other. Thus, a fluid or refrigerant gas, flowing from suction chamber 32 into one of spaces S through the suction-side end opening of bore 26, is transported to the discharge-side end opening of bore 26 while being confined within the space. FIG. 8 shows the way space S moves in accordance with the rotation of rotating member 24. At the location of the discharge-side end opening of bore 26, oblately shaped, space S changes its shape and position as is shown in FIGS. 9A, 9B, and 9C as membrs 24 and 28 rotate relatively to each other. While rotating member 24 makes one rotation, the discharge-side end of internal member 28 is situated once at each of longitudinal end portions A and B. At this point in time, space S communicates with discharge hole 56 of valve plate 42. In other words, while member 24 makes a turn, the refrigerant gas carried by spaces S is discharged twice into discharge chamber 34 through hole 56. As the refrigerant gas is discharged continuously into chamber 34, the gas is gradually compressed in this chamber, and delivered to a condenser (not shown) through pipe 38.

According to the compressor constructed in this manner, the refrigerant gas can be compressed by means of rotating member 24, which rotates integrally with rotor 22, and internal member 28, which revolves around an axis as the rotating member rotates. Therefore, unlike the conventional models, the compressor of this embodiment does not require that the roary motion of the rotor to be converted into a linear motion. Accordingly, the number of compressor components can be reduced, thus permitting simple construction and reducting manufacturing costs. Since the refrigerant gas is carried by means of a plurality of closed spaces S, it is capable of being continuously discharged, and the fluctuation of the driving torque for rotating member 24 can be restricted to a low level. Thus, the refrigerant gas can be smoothly compressed, and the vibration of the compressor can be attenuated.

By the agency of valve mechanism 52, moreover, the refrigerant gas can be prevented from flowing back into bore 26 from discharge chamber 34 of rotating member 24. Accordingly, the compressed gas can be prevented from expanding again, thus obviating the need of extra drive input. During the discharge operation, as is shown in FIG. 7, valve plate 42 is pressed against the discharge-side end face of rotating member 24 by back pressure P from discharge chamber 34. Thus, plate 42 is in airtight contact with the discharge-side end face of member 24, thereby sealing bore 26. Also, plate 42 is subjected to pressure q of the refrigerant gas from the bore side, somewhat canceling the back pressure. Consequently, the thrust acting on valve plate 42 is kept at a relatively small, optimum value.

It is to be understood that the present invention is not limited to the embodiment described above, and that various changes and modifications may be effected therein by one skilled in the art without departing from the scope or spirit of the invention.

Figure 10:
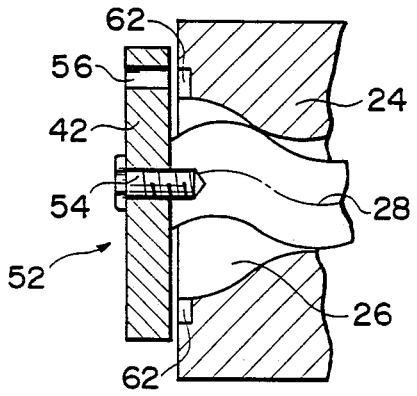
FIG. 10 is a sectional view showing a first modification of the valve mechanism.

FIG. 10 shows a first modification of valve mechanism 52. According to this modification, a pair of notches 62 are cut in the discharge-side end face of rotating member 24. These notches open individually to two opposite longitudinal ends A and B (see FIGS. 9A, 9B, and 9C) of the discharge-side end opening of bore 26. Valve plate 42 is formed with discharge hole 56 adapted to face notches 62 at the time of the refrigerant gas discharge. In this modification, moreover, a valve body and a valve guard are unnecessary.

Figure 11:
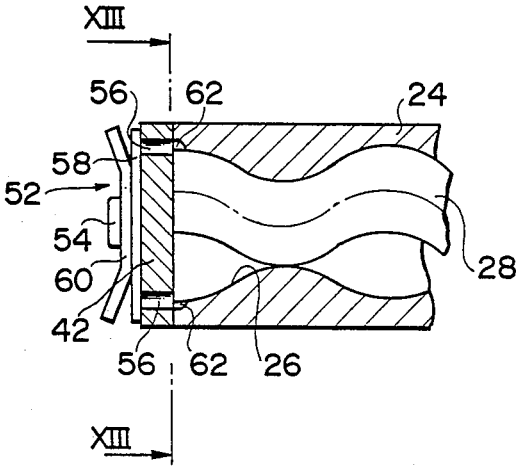
Figure 12:
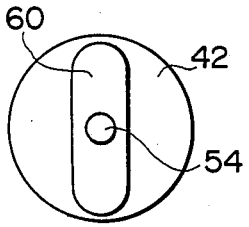
Figure 13:
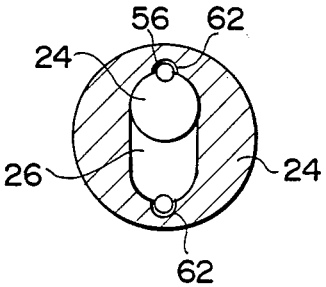

FIGS. 11, 12, and 13 show a second embodiment of the valve mechanism.

In this second modification, as in the first modification, a pair of notches 62, which open individually to two opposite longitudinal ends of the discharge-side end opening of bore 26, are cut in the discharge-side end face of rotating member 24. Valve plate 42 is formed with a pair of discharge holes 56 which face their corresponding notches 62 at all times. Valve body 58 and valve guard 60 are mounted on the discharge-chamber-side surface of plate 42. The valve body is used to open and close discharge holes 56. The respective central portions of body 58 and guard 60 are fixed to valve plate 42.

The first and second modifications can provide the same functions and effects of the aforementioned first embodiment.

Figure 14:
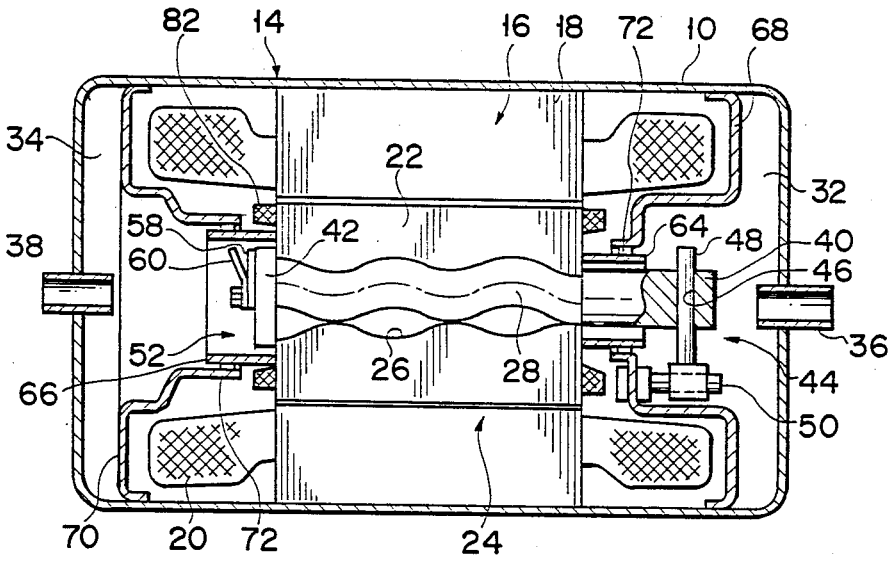
Figure 15:
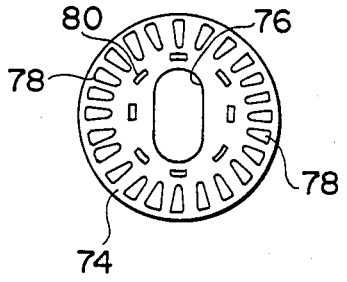
Figure 16:
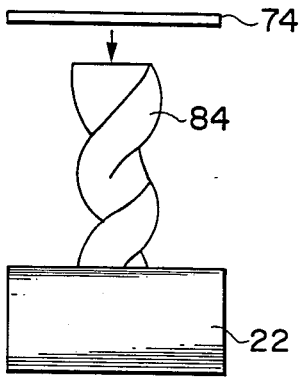
FIG. 16 is a side view schematically illustrating a method for manufacturing a rotor.

FIGS. 14, 15, and 16 show a compressor according to a second embodiment of the present invention. The second embodiment differs from the first embodiment only in that a rotating member is integrally formed with a rotor. In the description to follow, like reference numerals are used in order to designate like portions of the compressor.

According to this embodiment, rotor 22 serves as rotating member 24. Spiral bore 26 is formed in rotor 22, extending coaxially with the rotor's axis of rotation. Spirally twisted internal member 28 is passed through bore 26. Support cylinders 64 and 66 are fixed individually to two opposite end faces of rotor 22 so as to extend coaxially with the rotational axis of the rotor. Cylinders 64 and 66 are rotatably supported by first and second bearings 68 and 70, respectively, which are fixed to the inner surface of casing 10. The contact portions between cylinder 64 and bearing 68 and between cylinder 66 and bearing 70 are airtightly sealed by means of their corresponding seal members 72. Thus, suction chamber 32 is defined by bearing 68 and the inner surface of casing 10, while discharge chamber 34 is defined by bearing 70 and the inner surface of the casing.

Rotor 22 is formed by superposing a number of punched plates 74 (silicon-steel plates) to form a rotor core, as is shown in FIG. 15. Each plate 74 is in the form of a disk having a center opening shaped like a running track. Opening 76 constitutes part of bore 26. Punched plates 74 are joined, orienting them in their respective positions, which are slightly deviated from one another in accordance with the spiral shape of bore 26. Also, each plate 74 has a number of slots 78 arranged along its outer periphery and a number of caulking projections 80 formed between opening 76 and slots 78. When projections 80 re caulked with plates 74 superposed, the plates are coupled together. As the numerous punched plates are joined together, their holes 76 adjoin, thereby forming bore 26. Thus coupled with one another, punched plates 74 are fitted into a molding box, and molten aluminum is then poured into the box. Thereupon, rotor 22, having conductors, short-circuit rings, etc., is molded by die casting. Thus, rotor 22 of electric motor section 14 and rotating member 24 of compressor section 12 can be formed integrally. In order to prevent leakage into bore 26, it is advisable to coat the inner surface of the bore after die-casting rotor 22. Alternatively, the inner surface of bore 26 may be broached for higher working accuracy.

As is shown in FIG. 16, rotor 22 may be formed by superposing punched plates 74 in a manner such that core 84, having the same shape as bore 26, is passed through openings 76 of plates 74. In this case, it is not necessary for each plate 74 to have caulking projections 80.

Constructed in this manner, the second embodiment can provide the same functions and have the same effects as the first embodiment. According to the second embodiment, moreover, the rotating member is only composed of the rotor, so as to further reduce the number of components used.

What is claimed is:

1. A compressor comprising:

a closed casing having a suction chamber and a discharge chamber;

a rotating member rotatably arranged in the casing and having a spiral bore formed along the axis of rotation thereof, said bore having first and second end openings communicating with the suction chamber and the discharge chamber, respectively;

an electric motor section arranged in the casing, for rotating the rotating member;

a spiral internal member inserted in the bore of the rotating member so as to rotate relative to the rotating member while the rotating member rotates, said internal member, in conjunction with an inner surface of the bore, defining a plurality of closed spaces moving from the first end opening to the second end opening, whereby a fluid in the suction chamber is transported from the first end opening to the second end opening while being confined within the spaces, and is then discharged into the discharge chamber; and valve means for controlling the discharge of the fluid from the second end opening into the discharge chamber.

2. A compressor according to claim 1, wherein said rotating member has first and second end face to which the first and second end openings open, respectively; said internal member has an axial length substantially equal to that of the bore, and includes two ends and a head portion projecting from the suction-chamber-side end thereof into the suction chamber and partially engaging the first end face of the rotating member; and said valve means includes a valve plate fixed to the other end of the internal member to close the second end opening of the bore and being in contact with the second end face of the rotating member, said head portion and valve plate serving to restrain the internal member from moving axially with respect to the rotating member.

3. A compressor according to claim 2, wherein said bore has a slot-shaped cross section having two opposite ends with respect to the longitudinal direction thereof, and said valve means includes a discharge hole formed in the valve plate so as to face two opposite end portions of the second end opening, with respect to the longitudinal direction thereof, as the valve plate and the rotating member roll and rotate, respectively, said discharge hole connecting the bore and the discharge chamber when opposed to either of the longitudinal end portions of the second end opening.

4. A compressor according to claim 3, wherein said valve means includes a valve body fixed on a discharge-chamber side of the valve plate, for opening and closing the discharge hole.

5. A compressor according to claim 2, wherein said bore has a slot-shaped cross section having two opposite ends with respect to the longitudinal direction thereof, and said valve means includes a pair of notches formed in the rotating member and communicating individually with two opposite ends of the second end opening, with respect to the longitudinal direction thereof, and a discharge hole formed in the valve plate so as to face the notches as the valve plate and the rotating member roll and rotate, respectively, said discharge hole communicating the bore and the discharge chamber via the notches.

6. A compressor according to claim 5, wherein said valve means includes a second discharge hole formed in the valve plate so as to face one of the notches when said first discharge hole faces the other notch, and a valve body fixed on a discharge-chamber side of the valve plate, for opening and closing the first and second discharge holes.

7. A compressor according to claim 1, which further comprises rotation prevention means for preventing said internal member from rotating on its own axis, and to allow the internal member to move around the axis of rotation of said rotating member when the rotating member rotates.

8. The compressor according to claim 7, wherein said internal member includes a head portion projecting into the suction chamber and having a through hole extending perpendicular to the central axis of the internal member, and said rotation prevention means includes a guide pin slidably inserted in the through hole and a support member supporting the guide pin so as to be rockable around an axis parallel to the axis of rotation of the rotating member.

9. A compressor according to claim 1, which further comprises a bearing located in the casing, to divide the inside of the casing into the suction chamber and the discharge chamber, and rotatably supporting the rotating member.

10. A compressor according to claim 1, wherein said electric motor section includes a stator fixed to an inner surface of the casing and a rotor rotated by the stator, said rotating member being composed of the rotor, and said bore being formed in the rotor.

11. A compressor according to claim 10, wherein said rotor has two opposite end faces to which the first and second end openings of the bore open individually, and which further comprises a pair of support cylinders protruding from their corresponding end faces of the rotor, so as to be coaxial with the axis of rotation of the rotor, and a pair of bearings arranged in the casing and rotatably supporting the support cylinders.

* * * * *